US007340812B2

(12) United States Patent
Speck

(10) Patent No.: US 7,340,812 B2
(45) Date of Patent: Mar. 11, 2008

(54) SYSTEM FOR PROCESSING A CABLE USING AT LEAST TWO TOOLS

(75) Inventor: Marc Speck, Zug (CH)

(73) Assignee: Komax Holding AG, Dierikon (CH)

( * ) Notice: Subject to any disclaimer, the term of this patent is extended or adjusted under 35 U.S.C. 154(b) by 0 days.

(21) Appl. No.: 11/531,386

(22) Filed: Sep. 13, 2006

(65) Prior Publication Data

US 2007/0062024 A1 Mar. 22, 2007

(30) Foreign Application Priority Data

Sep. 19, 2005 (EP) ..... 05020404

(51) Int. Cl.
*B23P 23/00* (2006.01)

(52) U.S. Cl. ..... 29/33 M; 29/566; 29/745; 29/753; 29/857; 483/5

(58) Field of Classification Search ..... 29/566, 29/566.2, 593, 33 M, 33 F, 745, 748, 749, 29/760, 825, 857, 874, 863; 72/412, 413, 72/414, 421, 712; 483/4, 5, 6, 7, 8, 9, 10, 483/11, 12, 19

See application file for complete search history.

(56) References Cited

U.S. PATENT DOCUMENTS 3,249,997 A * 5/1966 Hutchens ..... 483/5
5,052,104 A * 10/1991 Tran ..... 29/861
5,412,856 A * 5/1995 Nazerian et al. ..... 29/33 M
5,539,967 A * 7/1996 Nazerian et al. ..... 29/33 M
5,809,849 A * 9/1998 Coffey et al. ..... 81/9.51
5,937,505 A * 8/1999 Strong et al. ..... 29/593
5,937,511 A * 8/1999 Hoffa et al. ..... 29/825
5,979,272 A * 11/1999 Wollermann ..... 81/9.51
6,099,575 A * 8/2000 Hardin et al. ..... 703/22
6,102,959 A * 8/2000 Hardin et al. ..... 703/2
6,272,740 B1 * 8/2001 Hoffa et al. ..... 29/825
6,336,267 B1 * 1/2002 Hoffa ..... 29/745
6,766,724 B2 * 7/2004 Bernardelle et al. ..... 83/861

(Continued)

FOREIGN PATENT DOCUMENTS

EP 0 889 560 A1 1/1999

(Continued)

*Primary Examiner*—Dana Ross
(74) *Attorney, Agent, or Firm*—Pearne & Gordon LLP

(57) ABSTRACT

The system (1) for processing a cable (5) comprises a first set of tools (30(*i*)), a second set of tools (35(*j*)) and a processing device (10) for executing different processing steps for processing a cable (5) using at least two tools (30(*i*), 35(*j*)). The processing device (10) comprises: a first holding device (15), which is intended for the purpose of removably holding a first tool (30(*i*)) which is selected from the first set of tools, and a second holding device (16), which is intended for the purpose of removably holding a second tool (35(*j*)) which is selected from the second set of tools, at least one tool of the first set being suitable for processing the cable exclusively in combination with one of the tools of a predetermined partial set of the second set. A test unit (40) comprises identification means (45) for identifying the first tool (30(*i*)) and the second tool (35(*j*) and a check device (55) for checking whether the identified tools (30(*i*) 35(*j*)) are each tools which are suitable for processing in combination with one another.

9 Claims, 5 Drawing Sheets

U.S. PATENT DOCUMENTS

Figure 1:
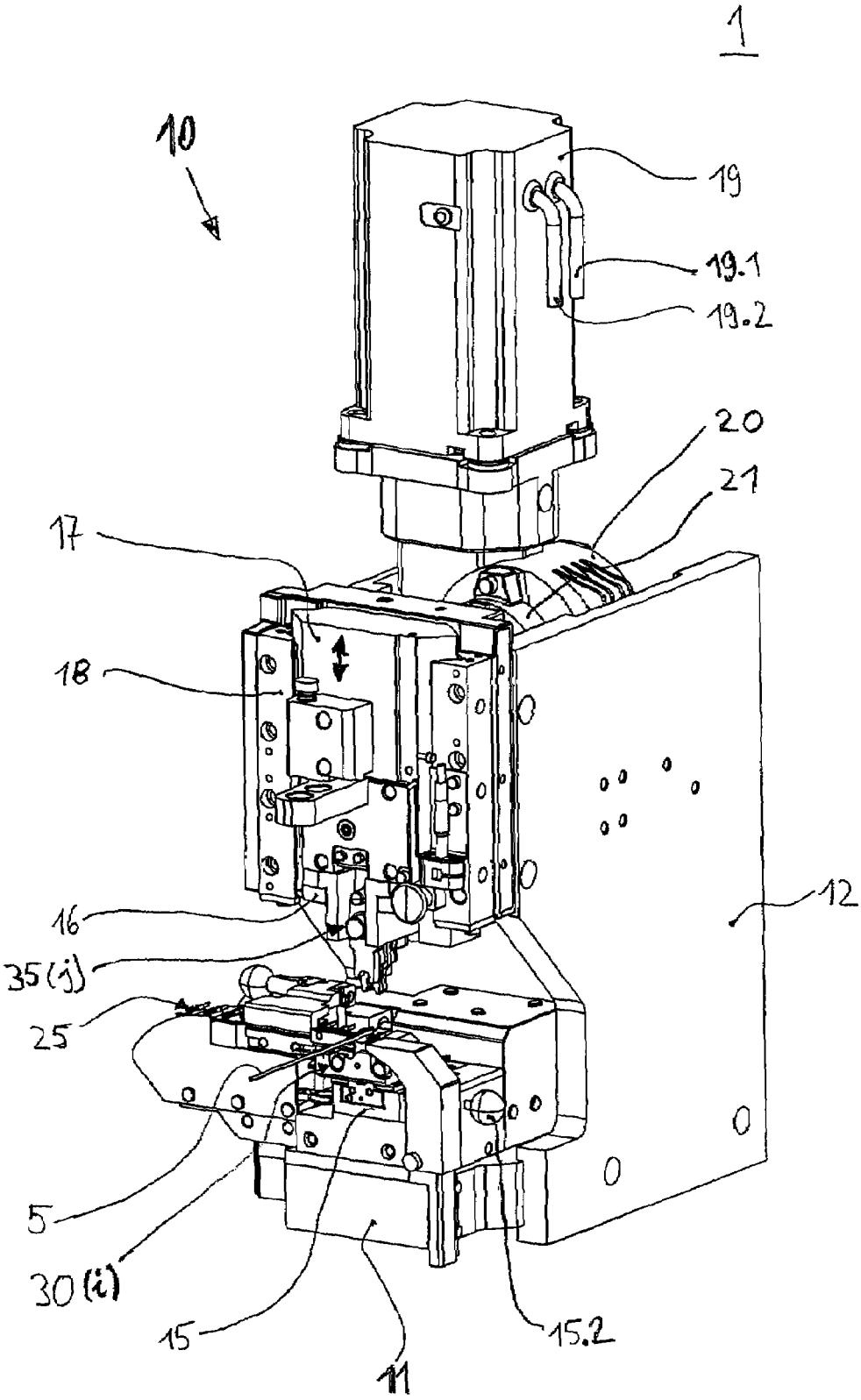

| | | | | |
|---|---|---|---|---|
| 6,854,177 | B2 * | 2/2005 | Hoffa | 29/745 |
| 2002/0178580 | A1 * | 12/2002 | Conte | 29/863 |
| 2003/0163916 | A1 * | 9/2003 | Conte | 29/709 |
| 2003/0172529 | A1 * | 9/2003 | Conte | 29/882 |
| 2003/0226426 | A1 * | 12/2003 | Mehri et al. | 81/9.51 |
| 2005/0050722 | A1 * | 3/2005 | Viviroli | 29/729 |

FOREIGN PATENT DOCUMENTS

| | | |
|---|---|---|
| EP | 1 381 123 A1 | 1/2004 |
| EP | 1 381 124 A1 | 1/2004 |

* cited by examiner

SYSTEM FOR PROCESSING A CABLE USING AT LEAST TWO TOOLS

The present invention relates to a system for processing a cable using at least two tools.

In cable processing, it is typical to use machines for specific processing steps, each of which acts on a cable to be processed using at least two tools. Depending on the application, different types of tools or tools having different shapes are required in each case. During cutting or stripping of an electrically conductive cable, for example, two cutters tailored to the shape and possibly the structure of the cable are pressed in opposite directions from diametrically opposing sides onto the cable to be processed and moved suitably in relation to one another in order to cut through both the insulation sheath and the conductor of the cable or only the insulation sheath. In order to provide an electrically conductive cable with an electrically conductive contact, which is connected to the conductor of the cable as solidly as possible, for example, a part of the insulation sheath of the cable is usually first removed at one end of the cable and in this way a section of the conductor of the cable is exposed. Subsequently, the end of the cable stripped in this way is brought into contact with a pre-shaped sheet metal part and processed using suitably shaped pressing tools in such a way that through deformation of the sheet metal part (known under the name "crimping"), a mechanical connection ("crimp connection") between the sheet metal part ("crimp contact") and the cable end is produced and correspondingly an electrical connection is produced between the sheet metal part and the exposed part of the conductor. Typically, crimping devices each having two tools are used to produce crimp connections of this type: an anvil tool (lower part of the crimp device), which is employed like an anvil and may be used for the purpose of supporting the crimp contact and the cable end to be connected to the crimp contact from one side, and a stamp tool (upper part of the crimp device), which is used for the purpose of pressing the crimp contact together with the cable end to be connected against the anvil tool and deforming it suitably.

Typically, multiple different tools must be provided for machine cable processing. For example, in order to process differently shaped crimp contacts, different crimp tools having differently shaped stamp tools and/or differently shaped anvil tools must be available. Furthermore, differently shaped tools are required in each case for executing different processing steps such as cutting, stripping, or crimping and for processing different cables having different shapes or different constructions.

Processing devices for processing cables are typically conceived in such a way that they are capable of processing cables having different shapes and different constructions in multiple different processing steps in each case, the tools of the processing device being exchangeable and replaceable by other tools. Processing devices of this type may be equipped before the execution of a specific processing step with the particular tools suitable for this processing step and may be reequipped as needed, if the processing device is to be caused to execute another processing step after executing a specific processing step.

The prior art includes, for example, a processing device for processing a cable having two tools in each case, which are components of a single exchangeable unit. This has the disadvantage that the different units provided for exchange are each relatively large and heavy and, in addition, partially comprise components which are required in more than one of the processing steps which may be implemented using the processing device. Therefore, several of these units comprise identical components. Providing multiple such units is therefore costly.

A crimping press having two tools is known from EP 1381124 A1, each of the tools being implemented as a replaceable part and each of the tools being exchangeable independently of the other tool. Since the tools are individually exchangeable and many tools may be easily confused because of their similarity, the danger is increased that when the crimping press is reequipped, a tool may be installed which is not suitable for an intended processing step. This causes multiple disadvantages: more rejects if unsuitable tools are used; an increased danger of damaging tools when executing processing steps for which they are not suitable; longer breakdown times; more effort in managing the different tools to be provided.

The present invention is based on the object of avoiding the disadvantages cited and implementing a system for processing cables using at least two tools which simplifies the exchange of the tools and allows reliable handling of multiple different tools.

This object is achieved by a system having the features to be described below.

The system according to the present invention for processing a cable comprises a first set of tools, a second set of tools, and a processing device for executing different processing steps for processing a cable using at least two tools.

It is a prerequisite that the processing device is equipped with one tool of the first set and one tool of the second set for executing a specific processing step in order to be able to process a cable through interaction of the two tools. Furthermore, it is assumed that two processing steps are considered "different" if the same combination of one tool of the first set and one tool of the second set is not used in each case for their execution.

The processing device comprises: (a) a first holding device which is intended for the purpose of removably holding a first tool, which is selected from the first set of tools, and (b) a second holding device, which is intended for the purpose of removably holding a second tool, which is selected from the second set of tools, the particular first tool and the particular second tool being able to be held using the holding devices in such a way that the first tool and the second tool act jointly on the cable during the execution of at least one of the processing steps.

Furthermore, it is a prerequisite that the processing steps are conceived in such a way that any arbitrary combinations of tools made of one tool of the first set and one tool of the second set are not suitable for processing cables. Accordingly, it is assumed that the tools differ in such a way that at least one tool of the first set is suitable for processing cables exclusively in combination with one of the tools of a predetermined partial set of the second set.

According to the present invention a test unit is provided, which comprises: identification means to identify the first tool and the second tool and a check device to check whether the identified tools are each tools which are suitable for processing in combination with one another. This test unit allows automatic recognition of the tool selected from the first set and the tool selected from the second set and an automatic check of whether these two tools are tailored to one another in such a way that they are suitable for executing one of the processing steps provided. The test unit thus helps to prevent the processing device from being equipped with tools which do not fit with one another.

The system according to the present invention thus has the advantage that the tools may be exchanged individually and independently from one another and nonetheless it is ensured by an automatic check that the processing device is equipped only with a combination of tools suitable for the particular processing steps. Improper use of tools may thus be avoided.

Various embodiments of the present invention are conceivable.

In one implementation of the present invention, each tool of the first set and each tool of the second set comprises an information carrier which provides identity data for identifying the particular tool, and the identification means comprise a detection device for detecting the particular identity data. Various tools may be characterized by different identity data and may thus be differentiated using the identification means.

In one embodiment of the present invention, the information carrier of at least one of the tools of the first set additionally provides suitability information, comprising data for specifying those tools of the second set which are suitable for processing in combination with the particular tool of the first set. Correspondingly, the information carrier of at least one of the tools of the second set may additionally contain suitability information comprising data for specifying those tools of the first set which are suitable for processing in combination with the particular tool of the second set. The suitability information of a tool may, for example, comprise the identity data of those other tools which are suitable for processing in combination with this tool. Only the detected identity data and particular suitability information must be analyzed by the check device. This is possible with little effort, because information which is provided using the information carriers of the identified tools must merely be compared by the check device. This embodiment therefore has the advantage that the check device may be implemented using especially simple means.

An alternative approach results in another embodiment in which the test unit comprises a data memory from which the identity data of the tools of the first and the second sets may be taken and which provides suitability information for each tool of the first set, comprising data for specifying those tools of the second set which are suitable for processing in combination with the particular tool of the first set. This variation has the advantage that all essential data, particularly the suitability information, is assembled and continuously available at a single central location. Inter alia, this has the advantage that this data may be changed with little effort, for example, if the stock of tools is to be expanded in order to allow implementation of further processing steps (e.g., in the event of modernization of the processing device).

The test unit may be used for the purpose of monitoring or controlling the processing device. The check device may, for example, comprise a processor, using which the suitability information provided for the particular identified tools may be analyzed and using which one or more control signals may be generated as a function of whether the identified tools are suitable or unsuitable for processing in combination with one another according to the suitability information provided. Control signals of this type may, for example, be used to release or block the operation of the processing device as a function of whether or not suitable tools were selected and identified for a specific processing step. Furthermore, transmission of results which the processor ascertains upon an analysis of the suitability information, e.g., to a display device or to a monitoring central office, may be caused.

There are no restrictions on the location at which the test unit may be installed. The test unit may, for example, be situated on the processing device or integrated in the processing device, for example, in such a way that the check of the first and the second tools may be performed when the first tool is held by the first holding device and the second tool is held by the second holding device or already during the installation of the tools in the processing device. Alternatively, the test unit may also be situated and operated separately from the processing device. The test unit may, for example, be situated at a location distal from the processing device, at which the tools intended for use in the processing device are stored. This allows the check of the tools to be performed in proximity to their storage space before transport of the tools to the processing device and/or installation of the tools in the processing device has occurred.

Figure 2:
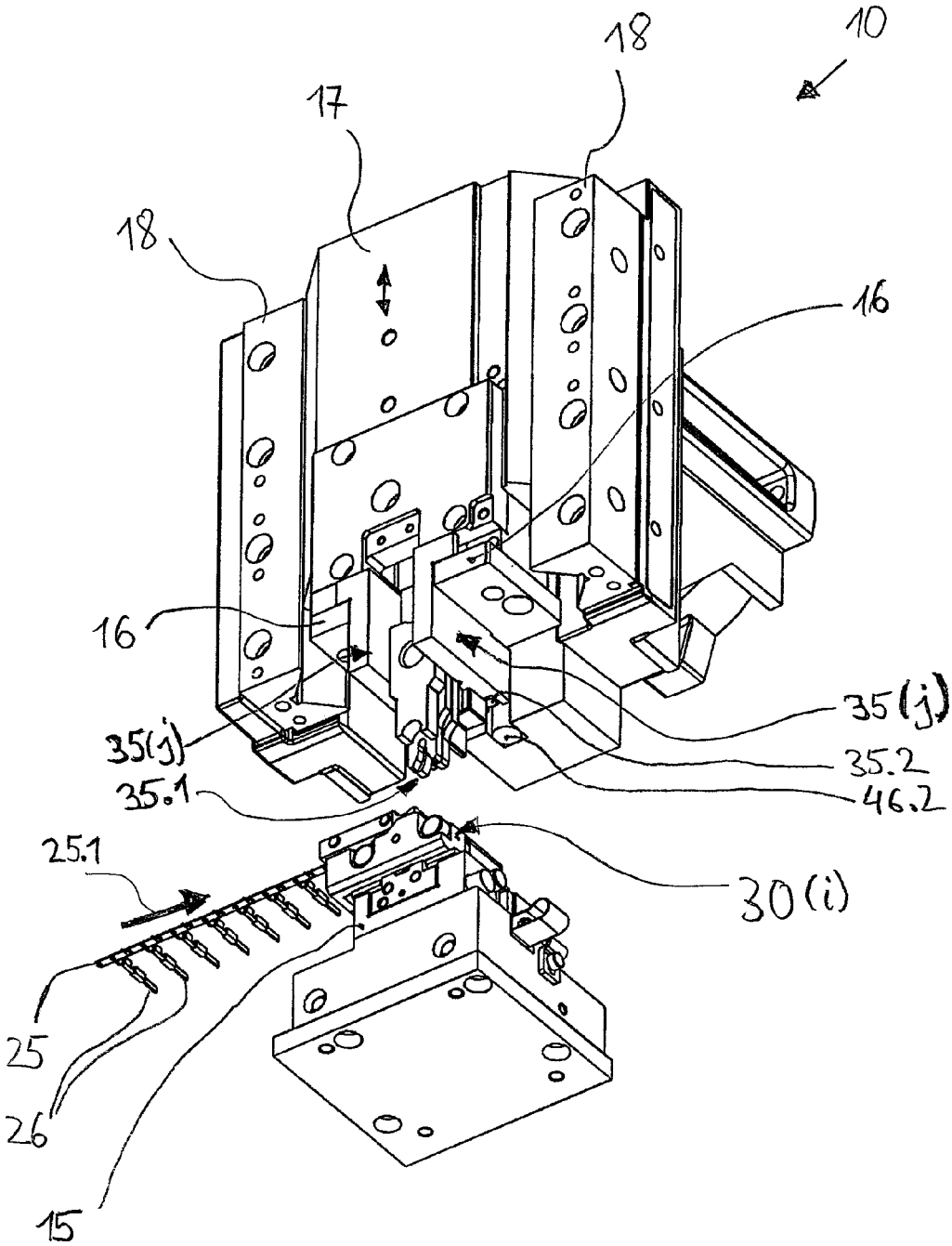
Figure 3:
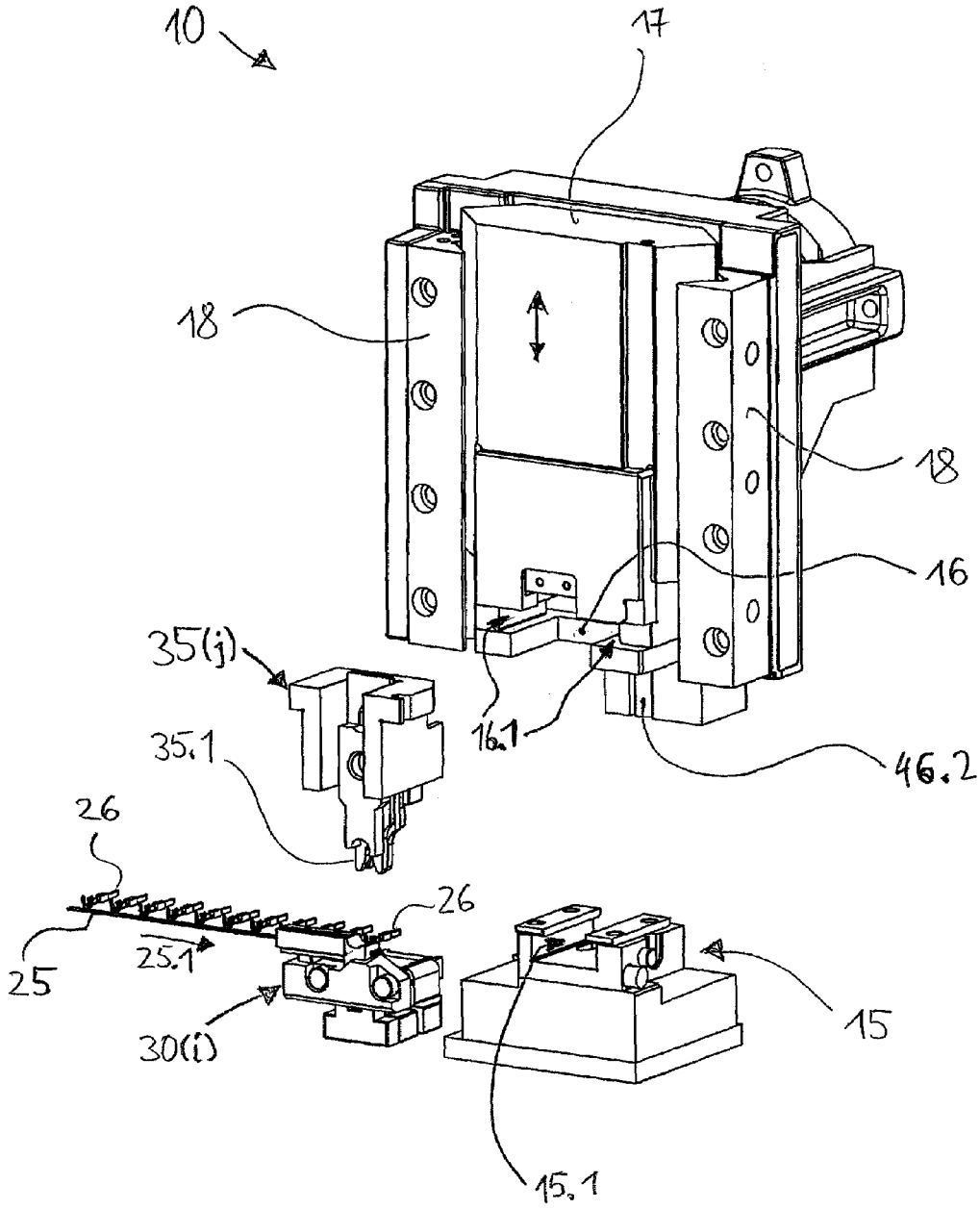
Figure 4:
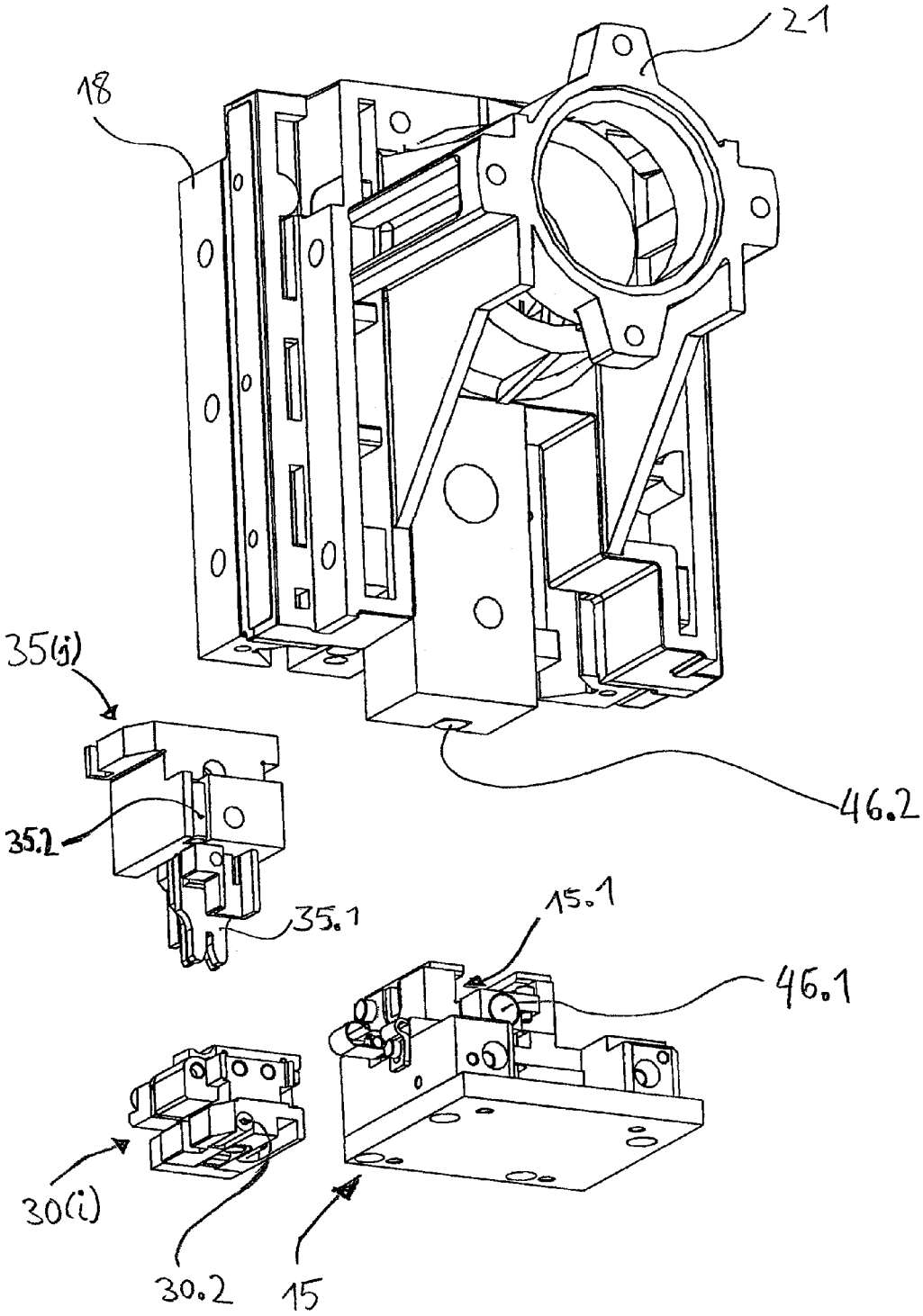
Figure 5:
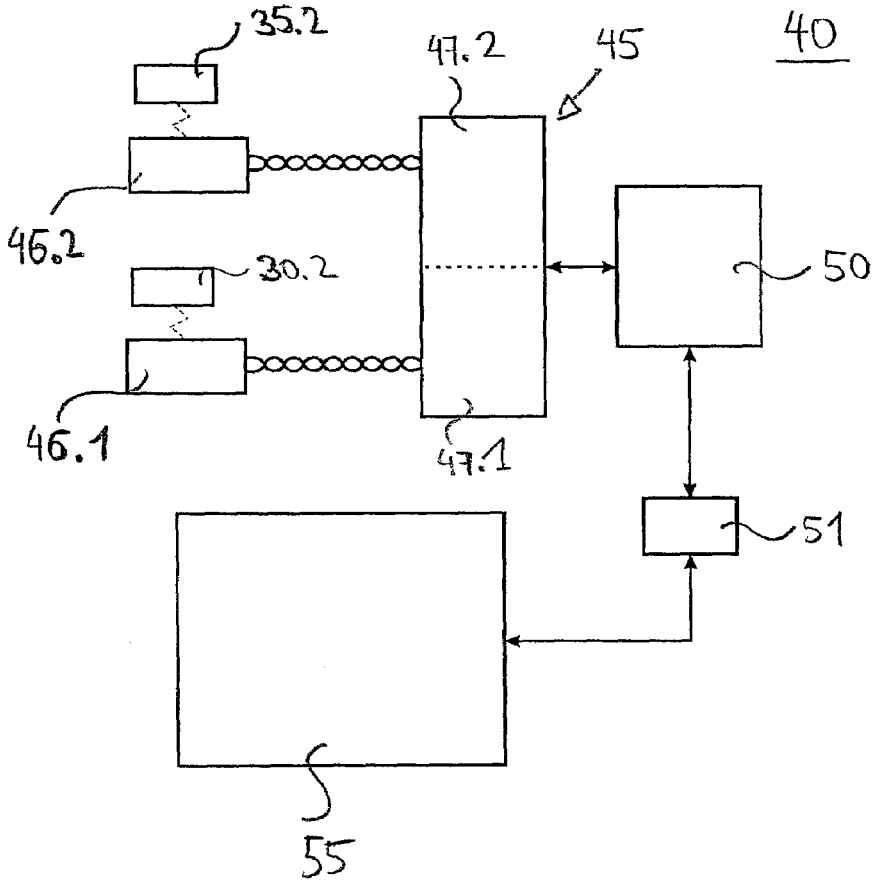

In the following, further details and particularly advantageous embodiments of the present invention are explained on the basis of schematic figures. In the drawing:

FIG. 1: shows a processing device for processing a cable, having two tools, each of which is inserted into a holding device;

FIG. 2: shows a part of the processing device from FIG. 1, illustrated from a different perspective and enlarged;

FIG. 3: shows the processing device from FIG. 2, the two tools being separated from the particular holding devices;

FIG. 4: shows the processing device from FIG. 3, but illustrated from a different perspective;

FIG. 5: shows a schematic illustration of a test unit according to the present invention.

FIGS. 1 through 5 illustrate a part of a system 1 for processing cables, the system comprising: (i) a processing device 10 for executing different processing steps for processing cables using at least two tools, (ii) a first set of tools, and (iii) a second set of tools. The tools are each replaceable parts, it being a prerequisite that, to execute a specific processing step, one suitable first tool must be selected from the first set and inserted into a first holding device 15 and one suitable second tool must be selected from the second set and inserted into a second holding device 16. The two tools are each removably held after insertion into the particular holding devices 15 and 16 in such a way that the first tool and the second tool act jointly on the cable to be processed during the execution of at least one of the processing steps.

In order to explain the outline of the present invention, the crimping of crimp contacts 26 at ends of sections of the cable 5 is shown in FIGS. 1 through 5 as an example. In the present case, an anvil tool 30(*i*) corresponding to the shape of the cable and/or the shape of the crimp contacts 26 is selected from the first set as the first tool, inserted into a groove 15.1 in the first holding device 15, and held removably using a catch mechanism 15.2 (as shown in FIGS. 1 through 4). A stamp tool 35(*j*) is selected from the second set in accordance with the shape of the cable 5 and/or the shape of the crimp contacts 26 as the second tool, inserted into a groove 16.1 in the second holding device 16 and held removably (as shown in FIGS. 1 through 4). The above indices i and j here symbolize a specific selection of a first tool from the first set and a second tool from the second set.

The processing device 10 has a support structure, which is formed by a baseplate 11 and side plates 12. The first holding device 15 is connected rigidly to the baseplate 11. The anvil tool 30(*i*) is accordingly immovable when it is inserted into the first holding device 15. The second holding device 16, in contrast, is attached to a slide 17, which is movable in the vertical direction along guides 18 using an electric motor 19. In order to be able to move the slide 17, the electric motor 19 is coupled via a gear 20 and an eccentric (not shown) enclosed by a housing 21 to the slide 17 and connected via a cable 19.1 to a power supply unit (not shown) and via a cable 19.2 to a controller (not shown). The stamp tool 35(*j*) is accordingly movable in a controlled way in the vertical direction.

In order to connect a crimp contact 26 to a (stripped) end of the cable 5, firstly a belt 25, which carries a supply of crimp contacts 26, is transported in the direction of the arrow 25.1 until a crimp contact 26 reaches a contact surface on the top of the anvil tool 30(*i*) and is cut off from the belt 25 using a cutter. A (stripped) end of the cable 5 is brought into position over this crimp contact 26. In order to finally produce a crimp connection between this crimp contact 26 and the end of the cable 5, the stamp tool 35(*j*) is lowered by activating the electric motor 19 and the crimp contact 26 is plastically deformed with the aid of the stamp 35.1 of the stamp tool 35(*j*).

The shape of the stamp 35.1 is precisely tailored to the shape of the crimp contact 26. If a crimp contact having a different shape is to be crimped onto the end of the cable 5 instead of the crimp contact 26 shown, it may be possible, for example, that the anvil tool 30(*j*) may be used further, typically, however, it will be necessary for the stamp tool 35(*j*) shown here to be replaced by another tool.

In order to ensure that the first holding device 15 and the second holding device 16 are only equipped with those tools of the first set and the second set, respectively, which are suitable for executing a specific processing step in combination with one another, all tools of the first set and the second set each have an information carrier which at least provides identity data, i.e., data which identify the particular tool.

For example, the first tool 30(*j*) has information carrier 30.2 (see FIG. 4) and the second tool 35(*j*) is equipped with information carrier 35.2.

By detecting the data provided by the information carriers, the particular tools may be identified. For example, FIG. 4 shows a detection device 46.1 which is situated in the first holding device 15 and is used for the purpose of detecting the data provided by the information carrier 30.2 using measuring technology means and receiving it. FIGS. 3 and 4 also show a detection device 46.2, which is situated on the second holding device 16 and is used for the purpose of detecting the data provided by the information carrier 35.2 and receiving it (see FIG. 4 in particular).

FIG. 5 schematically illustrates a variation of a test unit 40 according to the present invention. This comprises identification means 45 for the first tool (30(*i*) in the present example) and the second tool (35 (*j*) in the present example) and a check device 50, which communicates directly with the identification means 45 and via a communication interface 51 with a data memory 55. The identification means 45 comprise the detection devices 46.1 and 46.2, a read device 47.1 for reading the data received by the detection device 46.1, and a read device 47.2 for reading the data received by the detection device 46.2. The read devices 47.1 and 47.2 take the particular identity data of the first tool 30(*i*) and 35(*j*), respectively, from the data received by the detection devices 46.1 and 46.2, respectively, and thus perform identification of these tools. Suitability information is provided for each tool of the first set in the data memory 55, comprising data for specifying those tools of the second set which are suitable for processing in combination with the particular tool of the first set.

The check device 50 comprises a processor which analyzes the suitability information provided in the data memory 55 for the particular identified tools. In this way, the check device 50 ascertains whether the identified tools are each tools which are suitable for processing in combination with one another.

Furthermore, the check device generates suitable control signals in each case as a function of whether or not the identified tools are suitable for processing in combination with one another according to the suitability information provided.

In the example shown in FIGS. 1 through 5, each information carrier (such as the information carriers 30.2 and 35.2) is implemented as an RFID transponder having a data memory for the particular data. Correspondingly, the identification means 45 are conceived on the basis of RFID receivers, which are implemented for communication with the particular RFID transponders and/or for detecting the particular data. Accordingly, each of the detection devices 46.1 and 46.2 may be implemented as the antenna of an RFID receiver.

However, a test unit according to the present invention may also be implemented on the basis of other technologies which are suitable for data detection and/or data transmission. The functions of the information carriers 30.2 and 35.2 may, for example, also be implemented using corresponding information carriers which provide the particular data in a form readable using optical or magnetic or mechanical means. The identification means must then merely comprise corresponding means suitable for reading the particular data.

The test unit 40 shown in FIG. 5 may be simplified if the information carriers of at least one of the tools of the first set additionally provides suitability information comprising data for specifying those tools of the second set which are suitable for processing in combination with the particular tool of the first set. In this case, the data memory 55 and the communication interface 51 may be dispensed with because all relevant data are stored on the information carriers of the tools.

In general, it is advantageous to equip information carriers of the tools with data memories whose data contents may be changed arbitrarily. In this case, the contents of the information carriers may be adapted if changes are performed on the processing device or the stock of tools which is available for the operation of the processing device is to be expanded or changed. Furthermore, operating parameters of the processing device may also be stored on the information carriers, for example, the duration of usage of the particular tools.

The invention claimed is:

1. A system (1) for processing a cable (5), comprising:

a first set of tools (30 (*j*)), a second set of tools (35(*j*)), and a processing device (10) for executing different processing steps for processing a cable (5) using at least two tools (30(*j*), 35(*j*)), the processing device (10) comprising:

a first holding device (15) for removably holding a first tool (30(*j*)), which is selected from the first set of tools, a second holding device (16) for removably holding a second tool (35(*j*)), which is selected from the second set of tools, the first tool (30(*j*)) and the second tool (35(*j*)) being able to be held in such a way that the first tool and the second tool act jointly on the cable (5) during the execution of at least one of the processing steps, and at least one tool of the first set being suitable for processing the cable exclusively in combination with one of the tools of a predetermined partial set of the second set, characterized in that a test unit (40) is provided which comprises:

identification means (45) for identifying the first tool (30(*j*)) and the second tool (35(*j*)) and a check device (50) for checking whether the identified tools (30(*j*), 35 (*j*)) are suitable for processing in combination with one another.

2. The system according to claim 1, wherein the first tool and the second tool (30(*j*), 35(*j*)) are implemented for the purpose of cutting the cable or partially or entirely removing a sheath of the cable or producing a crimp connection between a crimp contact (26) and an end of an electrical conductor and/or a sheath of the cable (5) to be processed.

3. The system according to claim 1, wherein each tool (30(*j*)) of the first set and each tool (35(*j*)) of the second set comprises an information carrier (30.2, 35.2), which provides identity data for identifying the tool (30(*j*), 35(*j*)), and the identification means (45) comprise a detection device (46.1, 46.2) for detecting the identity data.

4. The system according to claim 3, wherein the information carrier (30.2, 35.2) of at least one of the tools (30(*j*)) of the first set additionally provides suitability information, comprising data for specifying those tools (35(*j*)) of the second set which are suitable for processing in combination with the tool of the first set.

5. The system according to claim 3, wherein the test unit (40) comprises a data memory (55), from which the identity data of the tools (30 (*j*), 35 (*j*)) of the first set and the second set may be taken and which provides suitability information for each tool of the first set, comprising data for specifying those tools of the second set which are suitable for processing in combination with the tool of the first set.

6. The system according to claims 4 or 5, wherein the check device (50) comprises a processor, using which the provided suitability information may be analyzed for the identified tools and using which a control signal may be generated if the identified tools (30(*j*), 35(*j*)) are not suitable for processing in combination with one another according to the suitability information provided.

7. The system according to one of claims 3 or 4, wherein each information carrier (30.2, 35.2) is implemented as an RFID transponder having a data memory for the data and the identification means (45) comprise an RFID receiver (46.1, 47.1; 46.2, 47.2), which is implemented for communication with the RFID transponders and/or for detecting the data.

8. The system according to one of claims 3 or 4, wherein each information carrier (30.2, 35.2) provides the data in a form readable using optical or magnetic or mechanical means and the identification means (45) comprise corresponding means suitable for reading the data.

9. The system according to claim 1, wherein the test unit (40) is situated on the processing device (10) or is integrated in the processing device (10), the check device (50) being situated in such way that the check of the first and the second tool may be performed when the first tool (30(*i*)) is held by the first holding device (15) and the second tool (35(*j*)) is held by the second holding device (16).

* * * * *